US008314749B2

(12) United States Patent
Shtrom et al.

(10) Patent No.: US 8,314,749 B2
(45) Date of Patent: Nov. 20, 2012

(54) DUAL BAND DUAL POLARIZATION ANTENNA ARRAY

(75) Inventors: Victor Shtrom, Los Altos, CA (US); William Kish, Saratoga, CA (US); Bernard Baron, Mountain View, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 13/240,687

(22) Filed: Sep. 22, 2011

(65) Prior Publication Data

US 2012/0007790 A1 Jan. 12, 2012

Related U.S. Application Data

(63) Continuation of application No. 12/605,256, filed on Oct. 23, 2009, now Pat. No. 8,031,129, which is a continuation-in-part of application No. 12/396,439, filed on Mar. 2, 2009, now Pat. No. 7,880,683, which is a continuation of application No. 11/646,136, filed on Dec. 26, 2006, now Pat. No. 7,498,996, and a continuation-in-part of application No. 11/041,145, filed on Jan. 21, 2005, now Pat. No. 7,362,280.

(60) Provisional application No. 60/753,442, filed on Dec. 23, 2005, provisional application No. 60/602,711, filed on Aug. 18, 2004.

(51) Int. Cl.
*H01Q 21/00* (2006.01)

(52) U.S. Cl. ..... 343/893; 343/853

(58) Field of Classification Search ..... 343/700 MS, 343/795, 893, 818, 876, 853
See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld et al. |
| 3,918,059 | A | 11/1975 | Adrian |
| 3,922,685 | A | 11/1975 | Opas |

(Continued)

FOREIGN PATENT DOCUMENTS

| | | |
|---|---|---|
| EP | 352 787 | 1/1990 |

(Continued)

OTHER PUBLICATIONS

"Authorization of spread spectrum and other wideband emissions not presently provided for in the FCC Rules and Regulations," Before the Federal Communications Commission, FCC 81-289, 87 F.C.C.2d 876, Jun. 30, 1981.

(Continued)

*Primary Examiner* — Hoang V Nguyen
(74) *Attorney, Agent, or Firm* — Lewis and Roca LLP

(57) ABSTRACT

A wireless device having vertically and horizontally polarized antenna arrays can operate at multiple frequencies concurrently. A horizontally polarized antenna array allows for the efficient distribution of RF energy in dual bands using, for example, selectable antenna elements, reflectors and/or directors that create and influence a particular radiation pattern. A vertically polarized array can provide a high-gain dual band wireless environment using reflectors and directors as well. The polarized horizontal antenna arrays and polarized vertical antenna arrays can operate concurrently to provide dual band operation simultaneously.

10 Claims, 9 Drawing Sheets

U.S. PATENT DOCUMENTS 3,967,067 A 6/1976 Potter
3,982,214 A 9/1976 Burns
3,991,273 A 11/1976 Mathes
4,001,734 A 1/1977 Burns
4,176,356 A 11/1979 Foster et al.
4,193,077 A 3/1980 Greenberg et al.
4,253,193 A 2/1981 Kennard
4,305,052 A 12/1981 Baril et al.
4,513,412 A 4/1985 Cox
4,554,554 A 11/1985 Olesen et al.
4,733,203 A 3/1988 Ayasli
4,814,777 A 3/1989 Monser
4,845,507 A 7/1989 Archer et al.
5,063,574 A 11/1991 Moose
5,097,484 A 3/1992 Akaiwa
5,173,711 A 12/1992 Takeuchi et al.
5,203,010 A 4/1993 Felix
5,208,564 A 5/1993 Burns et al.
5,220,340 A 6/1993 Shafai
5,282,222 A 1/1994 Fattouche et al.
5,291,289 A 3/1994 Hulyalkar et al.
5,311,550 A 5/1994 Fouche et al.
5,373,548 A 12/1994 McCarthy
5,507,035 A 4/1996 Bantz
5,532,708 A 7/1996 Krenz et al.
5,559,800 A 9/1996 Mousseau et al.
5,610,617 A 3/1997 Gans et al.
5,629,713 A * 5/1997 Mailandt et al. ..... 343/808
5,754,145 A 5/1998 Evans
5,767,755 A 6/1998 Kim et al.
5,767,809 A 6/1998 Chuang et al.
5,786,793 A 7/1998 Maeda et al.
5,802,312 A 9/1998 Lazaridis et al.
5,964,830 A 10/1999 Durrett
5,990,838 A 11/1999 Burns et al.
6,006,075 A 12/1999 Smith et al.
6,011,450 A 1/2000 Miya
6,018,644 A 1/2000 Minarik
6,031,503 A 2/2000 Preiss, II et al.
6,034,638 A 3/2000 Thiel et al.
6,052,093 A 4/2000 Yao et al.
6,091,364 A 7/2000 Murakami et al.
6,094,177 A 7/2000 Yamamoto
6,097,347 A 8/2000 Duan et al.
6,101,397 A * 8/2000 Grob et al. ..... 455/557
6,104,356 A 8/2000 Hikuma et al.
6,169,523 B1 1/2001 Ploussios
6,266,528 B1 7/2001 Farzaneh
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,337,628 B2 1/2002 Campana et al.
6,337,668 B1 1/2002 Ito et al.
6,339,404 B1 1/2002 Johnson et al.
6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skimore et al.
6,445,688 B1 9/2002 Garces et al.
6,452,981 B1 9/2002 Raleigh
6,456,242 B1 9/2002 Crawford
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,531,985 B1 3/2003 Jones et al.
6,583,765 B1 6/2003 Schamberger et al.
6,586,786 B2 7/2003 Kitazawa et al.
6,611,230 B2 8/2003 Phelan
6,621,464 B1 9/2003 Fang
6,625,454 B1 9/2003 Rappaport et al.
6,633,206 B1 10/2003 Kato
6,642,889 B1 11/2003 McGrath
6,674,459 B2 1/2004 Ben-Shachar et al.
6,701,522 B1 3/2004 Rubin et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,762,723 B2 7/2004 Nallo et al.
6,774,846 B2 8/2004 Fullerton et al.
6,779,004 B1 8/2004 Zintel
6,801,790 B2 10/2004 Rudrapatna
6,819,287 B2 11/2004 Sullivan et al.
6,839,038 B2 1/2005 Weinstein
6,859,176 B2 2/2005 Choi
6,859,182 B2 2/2005 Horii
6,876,280 B2 4/2005 Nakano
6,876,836 B2 4/2005 Lin et al.
6,888,504 B2 5/2005 Chiang et al.
6,888,893 B2 5/2005 Li et al.
6,892,230 B1 5/2005 Gu et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,941,143 B2 9/2005 Mathur
6,943,749 B2 9/2005 Paun
6,950,019 B2 9/2005 Bellone et al.
6,950,069 B2 9/2005 Gaucher et al.
6,961,026 B2 11/2005 Toda
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,034,769 B2 4/2006 Surducan et al.
7,034,770 B2 4/2006 Yang et al.
7,039,363 B1 5/2006 Kasapi et al.
7,043,277 B1 5/2006 Pfister
7,050,809 B2 5/2006 Lim
7,053,844 B2 5/2006 Gaucher et al.
7,064,717 B2 6/2006 Kaluzni et al.
7,075,485 B2 7/2006 Song et al.
7,084,823 B2 8/2006 Caimi et al.
7,085,814 B1 8/2006 Ghandhi et al.
7,088,299 B2 8/2006 Siegler et al.
7,089,307 B2 8/2006 Zintel et al.
7,130,895 B2 10/2006 Zintel et al.
7,171,475 B2 1/2007 Weisman et al.
7,193,562 B2 3/2007 Shtrom et al.
7,277,063 B2 10/2007 Shirosaka et al.
7,308,047 B2 12/2007 Sadowsky
7,312,762 B2 12/2007 Puente Ballarda et al.
7,319,432 B2 1/2008 Andersson
7,362,280 B2 4/2008 Shtrom et al.
7,424,298 B2 9/2008 Lastinger et al.
7,493,143 B2 2/2009 Jalali
7,498,996 B2 3/2009 Shtrom et al.
7,525,486 B2 4/2009 Shtrom et al.
7,603,141 B2 10/2009 Dravida
7,646,343 B2 1/2010 Shtrom et al.
7,675,474 B2 3/2010 Shtrom et al.
7,696,943 B2 4/2010 Chiang
7,880,683 B2 2/2011 Shtrom et al.
7,899,497 B2 3/2011 Kish et al.
7,965,252 B2 6/2011 Shtrom et al.
8,031,129 B2 10/2011 Shtrom et al.
2001/0046848 A1 11/2001 Kenkel
2002/0031130 A1 3/2002 Tsuchiya et al.
2002/0047800 A1 4/2002 Proctor, Jr. et al.
2002/0054580 A1 5/2002 Strich et al.

2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0158798 A1 10/2002 Chiang et al.
2002/0170064 A1 11/2002 Monroe et al.
2003/0026240 A1 2/2003 Eyuboglu et al.
2003/0030588 A1 2/2003 Kalis et al.
2003/0063591 A1 4/2003 Leung et al.
2003/0122714 A1 7/2003 Wannagot et al.
2003/0169330 A1 9/2003 Ben-Shachar et al.
2003/0184490 A1 10/2003 Raiman et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0227414 A1 12/2003 Saliga et al.
2004/0014432 A1 1/2004 Boyle
2004/0017310 A1 1/2004 Runkle et al.
2004/0017860 A1 1/2004 Liu
2004/0027291 A1 2/2004 Zhang et al.
2004/0027304 A1 2/2004 Chiang et al.
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0080455 A1 4/2004 Lee
2004/0095278 A1 5/2004 Kanemoto et al.
2004/0114535 A1 6/2004 Hoffmann et al.
2004/0125777 A1 7/2004 Doyle et al.
2004/0137864 A1 7/2004 Hwang
2004/0145528 A1 7/2004 Mukai et al.
2004/0160376 A1 8/2004 Hornsby et al.
2004/0190477 A1 9/2004 Olson et al.
2004/0203347 A1 10/2004 Nguyen
2004/0260800 A1 12/2004 Gu et al.
2005/0022210 A1 1/2005 Zintel et al.
2005/0041739 A1 2/2005 Li et al.
2005/0042988 A1 2/2005 Hoek et al.
2005/0048934 A1 3/2005 Rawnick et al.
2005/0074018 A1 4/2005 Zintel et al.
2005/0097503 A1 5/2005 Zintel et al.
2005/0105632 A1 5/2005 Catreux-Erces et al.
2005/0128983 A1 6/2005 Kim et al.
2005/0135480 A1 6/2005 Li et al.
2005/0138137 A1 6/2005 Encarnacion et al.
2005/0138193 A1 6/2005 Encarnacion et al.
2005/0146475 A1 7/2005 Bettner et al.
2005/0180381 A1 8/2005 Retzer et al.
2005/0188193 A1 8/2005 Kuehnel et al.
2005/0240665 A1 10/2005 Gu et al.
2005/0266902 A1 12/2005 Khatri
2005/0267935 A1 12/2005 Ghandhi et al.
2006/0007891 A1 1/2006 Aoki et al.
2006/0038734 A1 2/2006 Shtrom et al.
2006/0050005 A1 3/2006 Shirosaka et al.
2006/0078066 A1 4/2006 Yun
2006/0094371 A1 5/2006 Nguyen
2006/0098607 A1 5/2006 Zeng et al.
2006/0123124 A1 6/2006 Weisman et al.
2006/0123125 A1 6/2006 Weisman et al.
2006/0123455 A1 6/2006 Pai et al.
2006/0160495 A1 7/2006 Strong
2006/0168159 A1 7/2006 Weisman et al.
2006/0184660 A1 8/2006 Rao et al.
2006/0184661 A1 8/2006 Weisman et al.
2006/0184693 A1 8/2006 Rao et al.
2006/0224690 A1 10/2006 Falkenburg et al.
2006/0225107 A1 10/2006 Seetharaman et al.
2006/0227761 A1 10/2006 Scott, III et al.
2006/0239369 A1 10/2006 Lee
2006/0262015 A1 11/2006 Thornell-Pers et al.
2006/0291434 A1 12/2006 Gu et al.
2007/0027622 A1 2/2007 Cleron et al.
2007/0135167 A1 6/2007 Liu
2007/0162819 A1 7/2007 Kawamoto
2009/0075606 A1 3/2009 Shtrom et al.
2011/0205137 A1 8/2011 Shtrom et al.

FOREIGN PATENT DOCUMENTS

EP 0 534 612 3/1993
EP 0 756 381 1/1997
EP 1 152 452 11/2001
EP 1 376 920 6/2002
EP 1 220 461 7/2002
EP 1 315 311 5/2003
EP 1 450 521 8/2004
EP 1 608 108 12/2005
EP 1 152 453 11/2011
JP 2003-038933 2/1991
JP 2008-088633 2/1996
JP 2011-215040 8/1999
JP 2001/05760 1/2001
JP 2001-057560 2/2002
JP 2005-354249 12/2005
JP 2006-060408 3/2006
WO WO 90/04893 5/1990
WO WO 98/37590 8/1998
WO WO 02/25967 3/2002
WO WO 03/079484 9/2003
WO WO 2006/023247 3/2006

OTHER PUBLICATIONS

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

Alard, M., et al., "Principles of Modulation and Channel Coding for Digital Broadcasting for Mobile Receivers," 8301 EBU Review Technical, Aug. 1987, No. 224, Brussels, Belgium.

Ando et al., "Study of Dual-Polarized Omni-Directional Antennas for 5.2 GHz-Band 2x2 MIMO-OFDM Systems," Antennas and Propogation Society International Symposium, 2004, IEEE, pp. 1740-1743, vol. 2.

Areg Alimian et al., "Analysis of Roaming Techniques," doc.:IEEE 802.11-04/0377r1, Submission, Mar. 2004.

Bedell, Paul "Wireless Crash Course," 2005, p. 84, The McGraw-Hill Companies, Inc., USA.

Behdad et al., Slot Antenna Miniaturization Using Distributed Inductive Loading, Antenna and Propagation Society International Symposium, 2003 IEEE, vol. 1, pp. 308-311 (Jun. 2003).

Berenguer, Inaki, et al., "Adaptive MIMO Antenna Selection," Nov. 2003.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.

Casas, Eduardo F., et al., "OFDM for Data Communication Over Mobile Radio FM Channels-Part II: Performance Improvement," Department of Electrical Engineering, University of British Colombia.

Chang, Nicholas B. et al., "Optimal Channel Probing and Transmission Scheduling for Opportunistics Spectrum Access," Sep. 2007.

Chang, Robert W., "Synthesis of Band-Limited Orthogonal Signals for Mutichannel Data Transmission," The Bell System Technical Journal, Dec. 1966, pp. 1775-1796.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Cisco Systems, "Cisco Aironet Access Point Software Configuration Guide: Configuring Filters and Quality of Service," Aug. 2003.
Dell Inc., "How Much Broadcast and Multicast Traffic Should I Allow in My Network," PowerConnect Application Note #5, Nov. 2003.
Dunkels, Adam et al., "Connecting Wireless Sensornets with TCP/IP Networks," Proc. of the 2d Int'l Conf. on Wired Networks, Frankfurt, Feb. 2004.
Dunkels, Adam et al., "Making TCP/IP Viable for Wireless Sensor Networks," Proc. of the 1st Euro. Workshop on Wireless Sensor Networks, Berlin, Jan. 2004.
Dutta, Ashutosh et al., "MarconiNet Supporting Streaming Media Over Localized Wireless Multicast," Proc. of the 2d Int'l Workshop on Mobile Commerce, 2002.
English Translation of PCT Pub. No. WO2004/051798 (as filed U.S. Appl. No. 10/536,547).
Festag, Andreas, "What is MOMBASA?" Telecommunication Networks Group (TKN), Technical University of Berlin, Mar. 7, 2002.
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Golmie, Nada, "Coexistence in Wireless Networks: Challenges and System-Level Solutions in the Unlicensed Bands," Cambridge University Press, 2006.
Hewlett Packard, "HP ProCurve Networking: Enterprise Wireless LAN Networking and Mobility Solutions," 2003.
Hirayama, Koji et al., "Next-Generation Mobile-Access IP Network," Hitachi Review vol. 49, No. 4, 2000.
Ian R. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, No date.
Information Society Technologies Ultrawaves, "System Concept / Architecture Design and Communication Stack Requirement Document," Feb. 23, 2004.
Ken Tang, et al., "MAC Layer Broadcast Support in 802.11 Wireless Networks," Computer Science Department, University of California, Los Angeles, 2000 IEEE, pp. 544-548.
Ken Tang, et al., "MAC Reliable Broadcast in Ad Hoc Networks," Computer Science Department, University of California, Los Angeles, 2001 IEEE, pp. 1008-1013.
Mawa, Rakesh, "Power Control in 3G Systems," Hughes Systique Corporation, Jun. 28, 2006.
Microsoft Corporation, "IEEE 802.11 Networks and Windows XP," Windows Hardware Developer Central, Dec. 4, 2001.
Molisch, Andreas F., et al., "MIMO Systems with Antenna Selection—an Overview," Draft, Dec. 31, 2003.
Moose, Paul H., "Differential Modulation and Demodulation of Multi-Frequency Digital Communications Signals," 1990 IEEE, CH2831-6/90/0000-0273.
Pat Calhoun et al., "802.11r strengthens wireless voice," Technology Update, Network World, Aug. 22, 2005, http://www.networkworld.com/news/tech/2005/082208techupdate.html.
Press Release, NETGEAR RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi "Diversity Antennas for Portable Telephones," 39th IEEE Vehicular Technology, May 1-3, 1989, San Francisco, CA.
U.S. Appl. No. 95/001,078, filed Sep. 4, 2008.
U.S. Appl. No. 95/001,079, filed Sep. 4, 2008.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook 1998.
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.

* cited by examiner

DUAL BAND DUAL POLARIZATION ANTENNA ARRAY

CROSS-REFERENCE TO RELATED APPLICATION

The present application is a continuation and claims the priority benefit of U.S. patent application Ser. No. 12/605,256, filed Oct. 23, 2009, which is a continuation in part and claims the priority benefit of U.S. patent application Ser. No. 12/396,439 filed Mar. 2, 2009 and now U.S. Pat. No. 7,880,683, which is a continuation and claims the priority benefit of U.S. patent application Ser. No. 11/646,136 filed Dec. 26, 2006 and now U.S. Pat. No. 7,498,996, which claims the priority benefit of U.S. provisional application 60/753,442 filed Dec. 23, 2005; U.S. patent application Ser. No. 11/646,136 is also a continuation in part and claims the priority benefit of U.S. patent application Ser. No. 11/041,145 filed Jan. 21, 2005 and now U.S. Pat. No. 7,362,280, which claims the priority benefit of U.S. provisional application No. 60/602,711 filed Aug. 18, 2004. The disclosure of each of the aforementioned applications is incorporated herein by reference.

BACKGROUND OF THE INVENTION

1. Field of the Invention

The present invention generally relates to wireless communications. More specifically, the present invention relates to dual band antenna arrays.

2. Description of the Related Art

In wireless communications systems, there is an ever-increasing demand for higher data throughput and reduced interference that can disrupt data communications. A wireless link in an Institute of Electrical and Electronic Engineers (IEEE) 802.11 network can be susceptible to interference from other access points and stations, other radio transmitting devices, and changes or disturbances in the wireless link environment between an access point and remote receiving node. The interference may degrade the wireless link thereby forcing communication at a lower data rate. The interference may, in some instances, be sufficiently strong as to disrupt the wireless link altogether.

FIG. 1 is a block diagram of a wireless device 100 in communication with one or more remote devices and as is generally known in the art. While not shown, the wireless device 100 of FIG. 1 includes antenna elements and a radio frequency (RF) transmitter and/or a receiver, which may operate using the 802.11 protocol. The wireless device 100 of FIG. 1 can be encompassed in a set-top box, a laptop computer, a television, a Personal Computer Memory Card International Association (PCMCIA) card, a remote control, a mobile telephone or smart phone, a handheld gaming device, a remote terminal, or other mobile device.

In one particular example, the wireless device 100 can be a handheld device that receives input through an input mechanism configured to be used by a user. The wireless device 100 may process the input and generate a corresponding RF signal. The generated RF signal may then be transmitted to one or more receiving nodes 110-140 via wireless links. Nodes 120-140 may receive data, transmit data, or transmit and receive data (i.e., a transceiver).

Wireless device 100 may also be an access point for communicating with one or more remote receiving nodes over a wireless link as might occur in an 802.11 wireless network. The wireless device 100 may receive data as a part of a data signal from a router connected to the Internet (not shown) or a wired network. The wireless device 100 may then convert and wirelessly transmit the data to one or more remote receiving nodes (e.g., receiving nodes 110-140). The wireless device 100 may also receive a wireless transmission of data from one or more of nodes 110-140, convert the received data, and allow for transmission of that converted data over the Internet via the aforementioned router or some other wired device. The wireless device 100 may also form a part of a wireless local area network (LAN) that allows for communications among two or more of nodes 110-140.

For example, node 110 can be a mobile device with WiFi capability. Node 110 (mobile device) may communicate with node 120, which can be a laptop computer including a WiFi card or wireless chipset. Communications by and between node 110 and node 120 can be routed through the wireless device 100, which creates the wireless LAN environment through the emission of RF and 802.11 compliant signals.

Receiving nodes 105-120 can be different types of devices which are configured to communicate at different frequencies. Receiving node 105 may operate at a first frequency or band and receiving node 110 may operate on a second frequency. Current wireless devices may include omnidirectional antennas that are vertically and horizontally polarized in a single band, but do not operate as omnidirectional in multiple bands. What is needed is a wireless device that includes omnidirectional and multi-polarization antennas which operates in dual band.

SUMMARY OF THE PRESENTLY CLAIMED INVENTION

The present invention may include a wireless device having vertically and horizontally polarized antenna arrays, which concurrently operate at multiple frequencies. A horizontally polarized antenna array allows for the efficient distribution of RF energy in dual bands into a communications environment. The horizontally polarized antenna array may use selectable antenna elements, reflectors and/or directors that create and influence a particular radiation pattern (e.g., a substantially omnidirectional radiation pattern). A vertically polarized array can provide a high-gain dual band wireless environment such that one wireless environment does not interfere with other nearby wireless environments (e.g., between floors of an office building) and, further, avoids interference created by the other environments.

A first embodiment of an antenna system includes a horizontally polarized antenna array, a vertically polarized antenna array and a radio modulator/demodulator. The horizontally polarized antenna array can be configured to operate at a first frequency and a second frequency concurrently. The vertically polarized antenna array can be coupled to the horizontally polarized antenna array and configured to operate at the first frequency and the second frequency concurrently with the horizontally polarized antenna array. The radio modulator/demodulator can be configured to communicate a radio frequency signal with the horizontally polarized antenna array and vertically polarized antenna array.

DETAILED DESCRIPTION

Embodiments of the present invention allow for the use of wireless device having vertically and horizontally polarized antenna arrays, which concurrently operate at multiple frequencies. A horizontally polarized antenna array allows for the efficient distribution of RF energy in dual bands into a communications environment using, for example, selectable antenna elements, reflectors and/or directors that create and influence a particular radiation pattern (e.g., a substantially omnidirectional radiation pattern). A vertically polarized array can provide a high-gain dual band wireless environment such that one wireless environment does not interfere with other nearby wireless environments (e.g., between floors of an office building) and, further, avoids interference created by the other environments.

Figure 1:
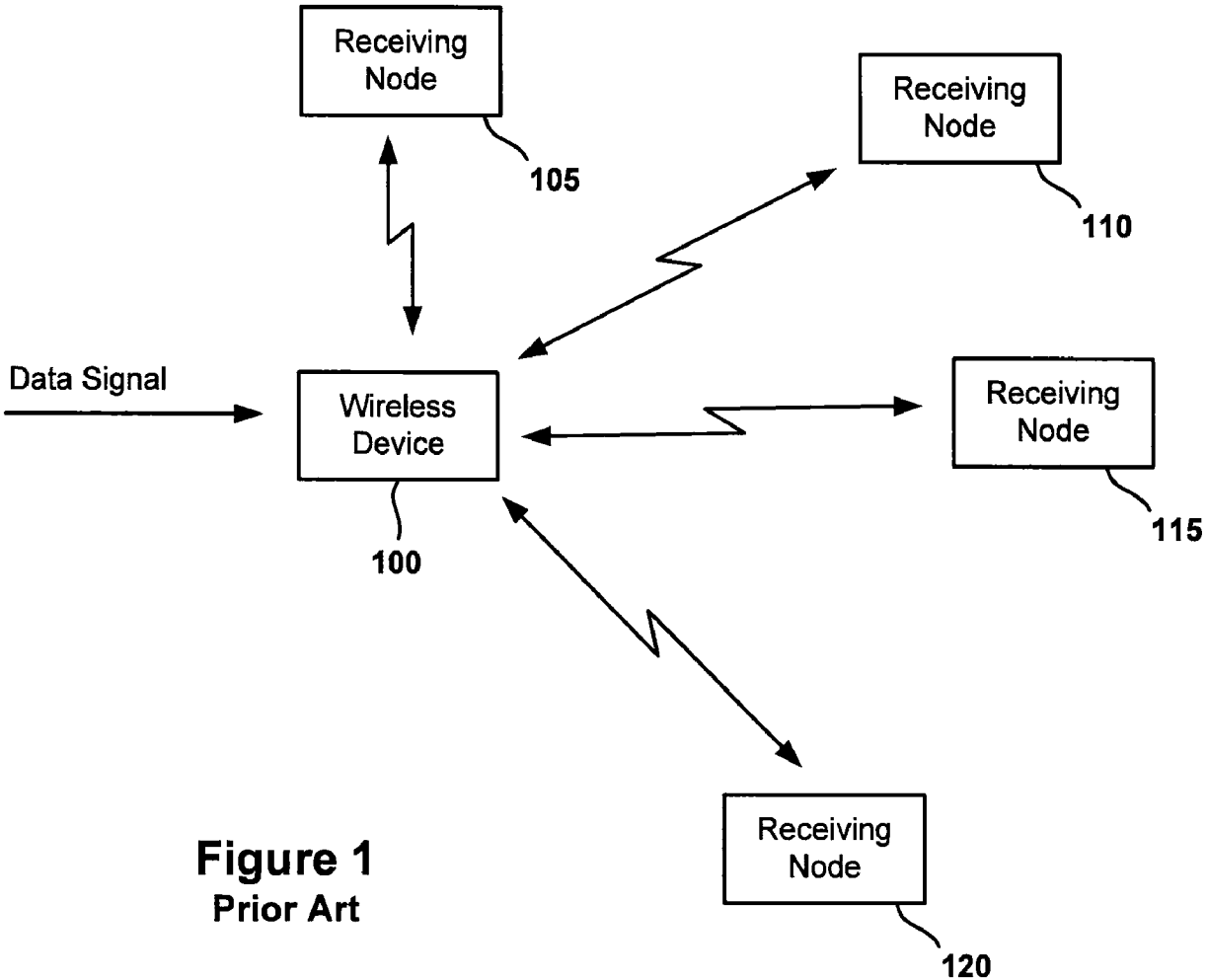
Figure 1 Prior Art
FIG. 1 is a block diagram of a wireless device in communication with one or more remote devices as known in the art.
Figure 2:
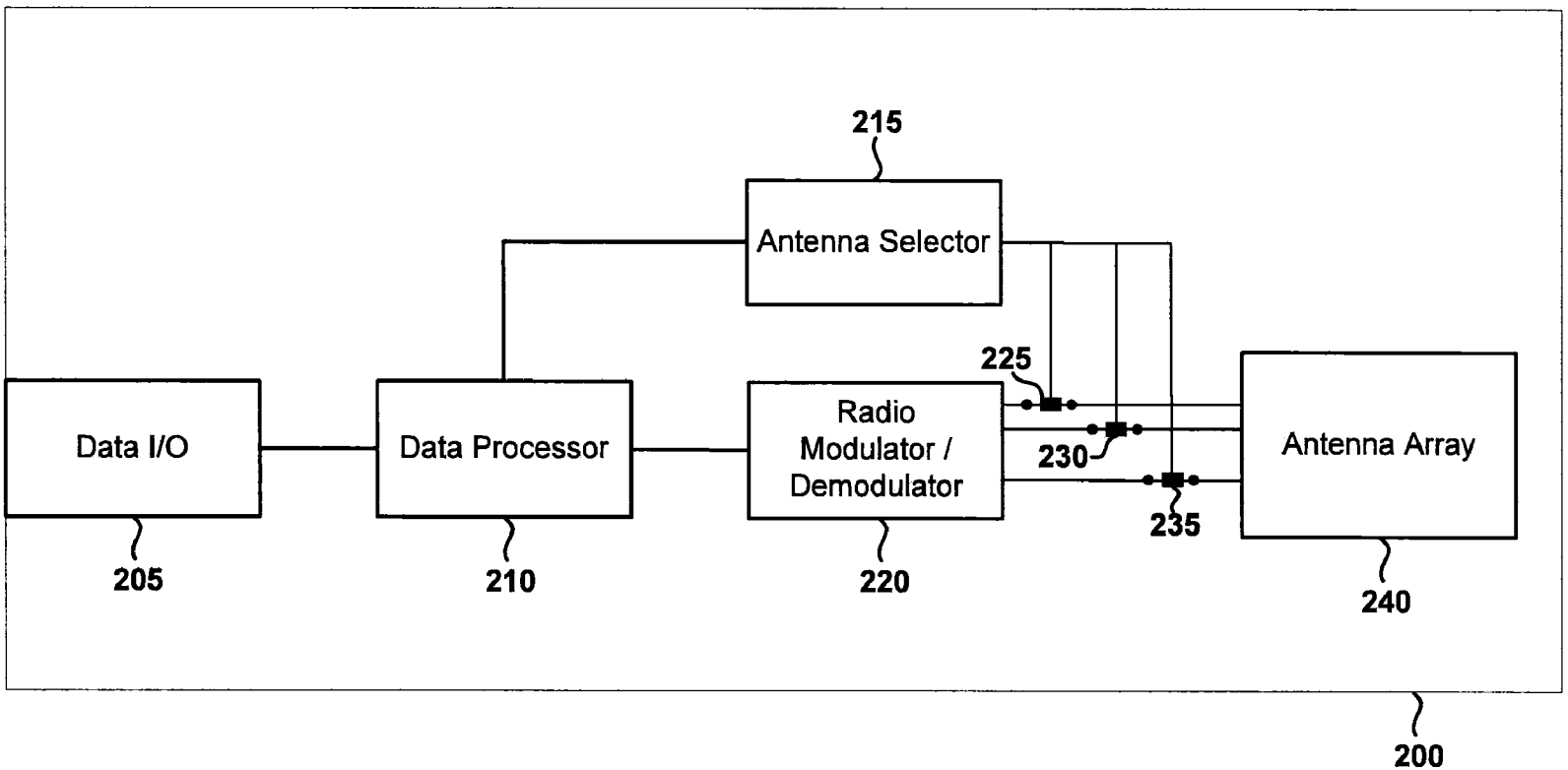
FIG. 2 a block diagram of a wireless device.

FIG. 2 is a block diagram of a wireless device 200. The wireless device 200 of FIG. 2 can be used in a fashion similar to that of wireless device 100 as shown in and described with respect to FIG. 1. The components of wireless device 200 can be implemented on one or more circuit boards. The wireless device 200 of FIG. 2 includes a data input/output (I/O) module 205, a data processor 210, radio modulator/demodulator 220, an antenna selector 215, diode switches 225, 230, 235, and antenna array 240.

The data I/O module 205 of FIG. 2 receives a data signal from an external source such as a router. The data I/O module 205 provides the signal to wireless device circuitry for wireless transmission to a remote device (e.g., nodes 110-140 of FIG. 1). The wired data signal can be processed by data processor 210 and radio modulator/demodulator 220. The processed and modulated signal may then be transmitted via one or more antenna elements within antenna array 240 as described in further detail below. The data I/O module 205 may be any combination of hardware or software operating in conjunction with hardware.

The antenna selector 215 of FIG. 2 can select one or more antenna elements within antenna array 240 to radiate the processed and modulated signal. Antenna selector 215 is connected to control one or more of diode switches 225, 230, or 235 to direct the processed data signal to one or more antenna elements within antenna array 240. The number of diode switches controlled by antenna selector 215 can be smaller or greater than the three diode switches illustrated in FIG. 2. For example, the number of diode switches controlled can correspond to the number of antenna elements and/or reflectors/directors in the antenna array 240. Antennal selector 215 may also select one or more reflectors/directors for reflecting the signal in a desired direction. Processing of a data signal and feeding the processed signal to one or more selected antenna elements is described in detail in U.S. Pat. No. 7,193,562, entitled "Circuit Board Having a Peripheral Antenna Apparatus with Selectable Antenna Elements," the disclosure of which is incorporated by reference.

Antenna array 240 can include horizontal antenna element arrays and vertical antenna element arrays. The antenna element arrays can include a horizontal antenna array and a vertical antenna array, each with two or more antenna elements. The antenna elements can be configured to operate at different frequencies concurrently such as 2.4 GHZ and 5.0 GHz. Antenna array 240 can also include a reflector/controller array.

Figure 3:
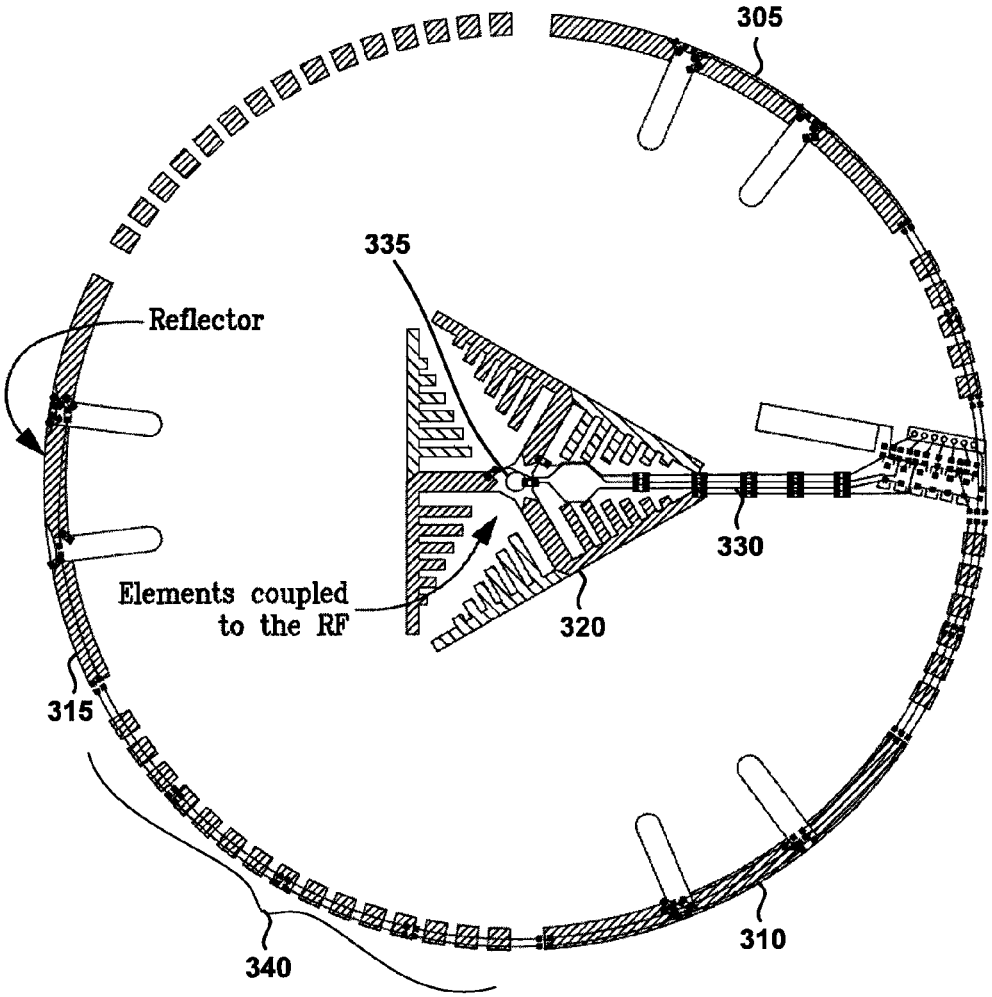
FIG. 3 illustrates a horizontal antenna array including both selectively coupled antenna elements and selectively coupled reflector/directors.

FIG. 3 illustrates an exemplary horizontal antenna array including both selectively coupled antenna elements and selectively coupled reflector/directors. The antenna array of FIG. 3 includes reflectors/directors 305, 310 and 315, horizontal antenna array 320, coupling network 330, and feed port 335. Horizontal antenna array 320 may transmit and receive an RF signal with one or more of receiving nodes 105-120. Horizontal antenna array 320 may also receive a feed RF signal through coupling network 330. Horizontal antenna array 320 is discussed in more detail with respect to FIG. 4.

The reflector/directors 305, 310 and 315 can comprise passive elements (versus an active element radiating RF energy) and be configured to constrain the directional radiation pattern of dipoles formed by antenna elements of antenna array 230. The reflector/directors can be placed on either side of the substrate (e.g., top or bottom). Additional reflector/directors (not shown) can be included to further influence the directional radiation pattern of one or more of the modified dipoles.

Each of the reflectors/directors 305, 310 and 315 can be selectively coupled to a ground component within the horizontal antenna array of FIG. 3. A reflector coupled to ground can reflect an RF signal. The radiation pattern can be constrained, directed or reflected in conjunction with portions of the ground component selectively coupled to each reflector/director. The reflector/directors (e.g., parasitic elements) can be configured such that the length of the reflector/directors may change through selective coupling of one or more reflector/directors to one another. For example, a series of interrupted and individual parasitic elements 340 that are 100 mils in length can be selectively coupled in a manner similar to the selective coupling of the aforementioned antenna elements.

By coupling together a plurality of the reflector elements, the elements may effectively become reflectors that reflect and otherwise shape and influence the RF pattern emitted by the active antenna elements (e.g., back toward a drive dipole resulting in a higher gain in that direction). RF energy emitted by an antenna array can be focused through these reflectors/directors to address particular nuances of a given wireless environment. Similarly, the parasitic elements (through decoupling) can be made effectively transparent to any emitted radiation pattern. Similar reflector systems can be implemented on other arrays (e.g., a vertically polarized array).

A similar implementation can be used with respect to a director element or series of elements that may collectively operate as a director. A director focuses energy from an RF source away from the source thereby increasing the gain of the antenna. Both reflectors and directors can be used to affect and influence the gain of the antenna structure. Implementation of the reflector/directors can occur on all antenna arrays in a wireless device, a single array, or on selected arrays.

The horizontally polarized antenna array 320 in FIG. 3 can receive signals from coupling network 330 via feed port 335. The feed port 335 is depicted as a small circle in the middle of the horizontally polarized antenna array 320. The feed port 335 can be configured to receive and transmit an RF signal to a communications device (such as receiving nodes 105-120)

and a coupling network 330 for selecting one or more of the antenna elements. The RF signal can be received from, for example, an RF coaxial cable coupled to the aforementioned coupling network. The coupling network 330 can include DC blocking capacitors and active RF switches to couple the radio frequency feed port 335 to one or more of the antenna elements. The RF switches may include a PIN diode or gallium arsenide field-effect transistor (GaAs FET) or other switching devices as are known in the art. The PIN diodes may include single-pole single-throw switches to switch each antenna element either on or off (i.e., couple or decouple each of the antenna elements to the feed port 335).

Figure 4:
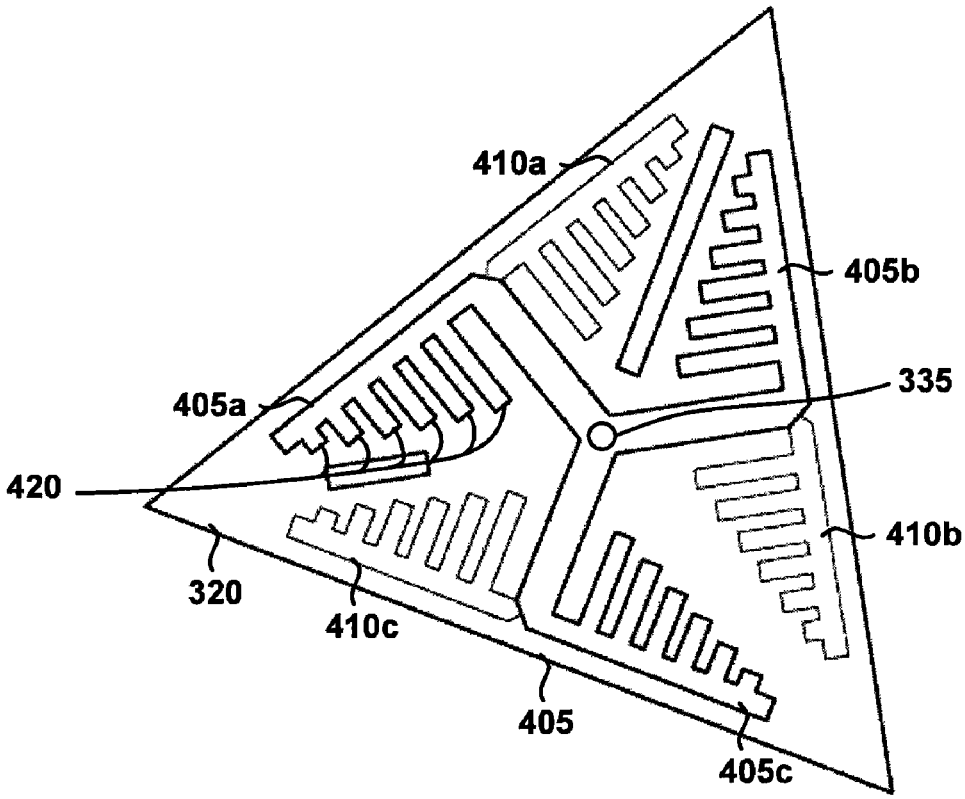
FIG. 4 illustrates a triangular configuration of a horizontally polarized antenna array with selectable elements.

FIG. 4 illustrates an exemplary horizontally polarized antenna array 320 with selectable antenna elements. The horizontally polarized antenna array has a triangular configuration which includes a substrate having a first side (solid lines 405) and a second side (dashed lines 410) that can be substantially parallel to the first side. The substrate may comprise, for example, a PCB such as FR4, Rogers 4003 or some other dielectric material.

On the first side of the substrate (solid lines 405) in FIG. 4, the antenna array 320 includes radio frequency feed port 335 selectively coupled to three antenna elements 405*a*, 405*b* and 405*c*. Although three antenna elements are depicted in FIG. 4, more or fewer antenna elements can be implemented. Further, while antenna elements 405*a*-405*c* of FIG. 4 are oriented substantially to the edges of a triangular shaped substrate, other shapes and layouts, both symmetrical and non-symmetrical, can be implemented. Furthermore, the antenna elements 405*a*-405*c* need not be of identical dimension notwithstanding such a depiction in FIG. 4.

On the second side of the substrate, depicted as dashed lines in FIG. 4, the antenna array 320 includes a ground component 410 including portions 410*a*, 410*b* and 410*c*. A portion 410*a* of the ground component 410 can be configured to form a modified dipole in conjunction with the antenna element 405*a*. Each of the ground components can be selectively coupled to a ground plane in the substrate 405 (not shown). As shown in FIG. 4, a dipole is completed for each of the antenna elements 405*a*-405*c* by respective conductive traces 410*a*-410*c* extending in mutually opposite directions. The resultant modified dipole provides a horizontally polarized directional radiation pattern (i.e., substantially in the plane of the antenna array 320).

To minimize or reduce the size of the antenna array 320, each of the modified dipoles (e.g., the antenna element 405*a* and the portion 410*a* of the ground component) may incorporate one or more loading structures 420. For clarity of illustration, only the loading structures 420 for the modified dipole formed from antenna element 405*a* and portion 410*a* are numbered in FIG. 4. By configuring loading structure 420 to slow down electrons and change the resonance of each modified dipole, the modified dipole becomes electrically shorter. In other words, at a given operating frequency, providing the loading structures 420 reduces the dimension of the modified dipole. Providing the loading structures 420 for one or more of the modified dipoles of the antenna array 320 minimizes the size of the loading structure 420.

Antenna selector 215 of FIG. 2 can be used to couple the radio frequency feed port 335 to one or more of the antenna elements within the antenna element array 320. The antenna selector 215 may include an RF switching devices, such as diode switches 225, 230, 235 of FIG. 2, a GaAs FET, or other RF switching devices to select one or more antenna elements of antenna element array 320. For the exemplary horizontal antenna array 320 illustrated in FIG. 3, the antenna element selector can include three PIN diodes, each PIN diode connecting one of the antenna elements 405*a*-405*c* (FIG. 4) to the radio frequency feed port 335. In this embodiment, the PIN diode comprises a single-pole single-throw switch to switch each antenna element either on or off (i.e., couple or decouple each of the antenna elements 405*a*-405*c* to the radio frequency feed port 335).

A series of control signals can be used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 335 and the PIN diodes of the antenna element selector are on the side of the substrate with the antenna elements 405*a*-405*c*, however, other embodiments separate the radio frequency feed port 335, the antenna element selector, and the antenna elements 405*a*-405*c*.

One or more light emitting diodes (LED) (not shown) can be coupled to the antenna element selector. The LEDs function as a visual indicator of which of the antenna elements 405*a*-405*c* is on or off. In one embodiment, an LED is placed in circuit with the PIN diode so that the LED is lit when the corresponding antenna element 410 is selected.

The antenna components (e.g., the antenna elements 405*a*-405*c*, the ground component 410, and the reflector/directors directors 305, 310 and 315) are formed from RF conductive material. For example, the antenna elements 405*a*-405*c* and the ground component 410 can be formed from metal or other RF conducting material. Rather than being provided on opposing sides of the substrate as shown in FIG. 4, each antenna element 405*a*-405*c* is coplanar with the ground component 410.

The antenna components can be conformally mounted to a housing. The antenna element selector comprises a separate structure (not shown) from the antenna elements 405*a*-405*c* in such an embodiment. The antenna element selector can be mounted on a relatively small PCB, and the PCB can be electrically coupled to the antenna elements 405*a*-405*c*. In some embodiments, a switch PCB is soldered directly to the antenna elements 405*a*-405*c*.

Antenna elements 405*a*-405*c* can be selected to produce a radiation pattern that is less directional than the radiation pattern of a single antenna element. For example, selecting all of the antenna elements 405*a*-405*c* results in a substantially omnidirectional radiation pattern that has less directionality than the directional radiation pattern of a single antenna element. Similarly, selecting two or more antenna elements may result in a substantially omnidirectional radiation pattern. In this fashion, selecting a subset of the antenna elements 405*a*-405*c*, or substantially all of the antenna elements 405*a*-405*c*, may result in a substantially omnidirectional radiation pattern for the antenna array 320.

Reflector/directors 305, 310, 315 and 340 may further constrain the directional radiation pattern of one or more of the antenna elements 405*a*-405*c* in azimuth. Other benefits with respect to selectable configurations are disclosed in U.S. patent application Ser. No. 11/041,145 filed Jan. 21, 2005, now issued as U.S. Pat. No. 7,362,280 and entitled "System and Method for a Minimized Antenna Apparatus with Selectable Elements," the disclosure of which is incorporated herein by reference.

Figure 5:
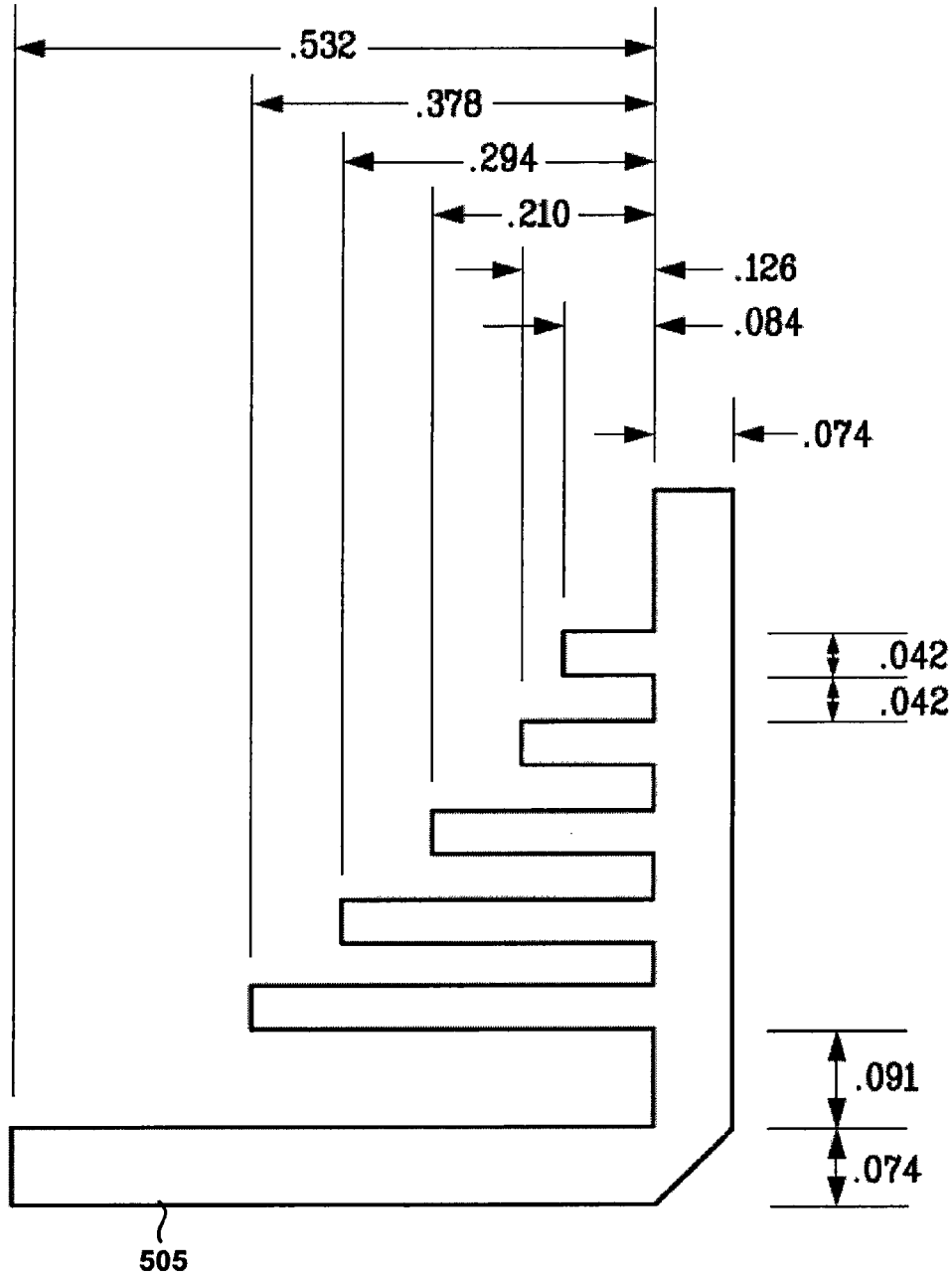
FIG. 5 illustrates a set of dimensions for one antenna element of the horizontally polarized antenna array shown in FIG. 4.

FIG. 5 illustrates an exemplary set of dimensions for one antenna element of the horizontally polarized antenna array 320 illustrated in FIGS. 3 and 4. The dimensions of individual components of the antenna array 320 (e.g., the antenna element 405*a* and the portion 410*a*) may depend upon a desired operating frequency of the antenna array 320. RF simulation software can aid in establishing the dimensions of the individual components. The antenna component dimensions of the antenna array 320 illustrated in FIG. 5 are designed for operation near 2.4 GHz based on a Rogers 3203 PCB substrate. A different substrate having different dielectric properties, such as FR4, may require different dimensions than those shown in FIG. 5, as would a substrate having an antenna element configured for operation near 5.0 GHZ.

Figure 6:
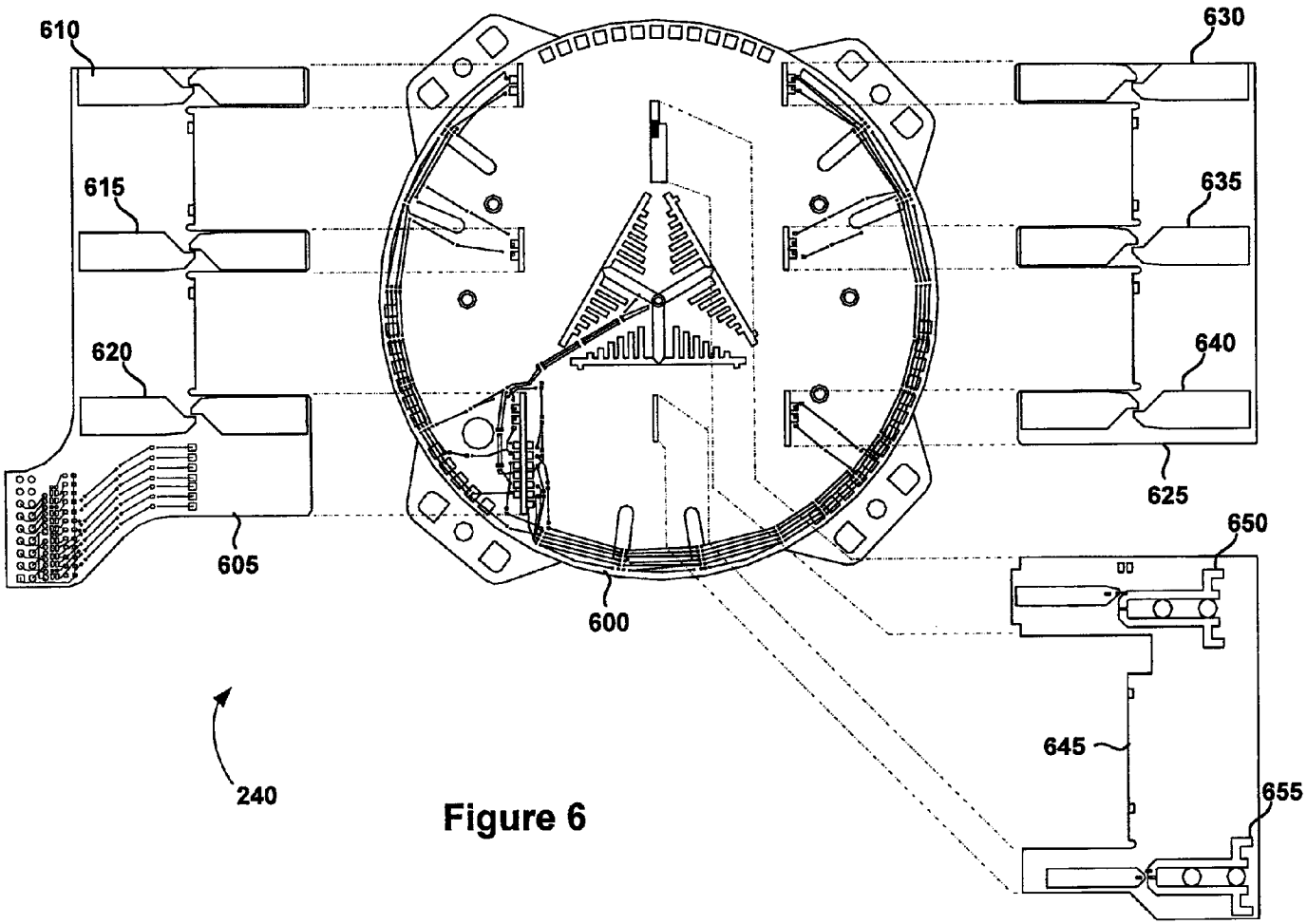
FIG. 6 illustrates an antenna array structure including a horizontal antenna array coupled to a plurality of vertical antenna arrays.

FIG. 6 illustrates an antenna structure for coupling vertical antenna arrays and reflectors/directors to a horizontal antenna array. Horizontal antenna array 600 includes a plurality of slots in a PCB for receiving antenna and reflector/director arrays. The horizontal antenna array includes two slots for receiving vertical antenna array 645, three slots for reflector/director array 605 and three slots for reflector/director array 625.

Vertical antenna array 645 includes two selectable vertical antennas 650 and 655 and can be coupled to the horizontal antenna array 600 by direct soldering at a trace, use of a jumper resistor, or some other manner. In the exemplary embodiment illustrated, the vertical antenna array 645 is coupled using slots positioned along an approximate center axis of the horizontal antenna array. Each vertical antenna is configured as an active element, is coupled to an RF feed port and can be selected using a PIN diode or other mechanism. The antenna elements of vertical antenna array 645 can operate at about 2.4 GHz.

Reflector/director array 605 includes reflectors 610, 615 and 620. Each of the reflectors/directors is passive elements and can be selected to form a connection with a ground plane portion to reflect a radiated RF signal. Reflector/director array 625 includes selectable reflectors/directors 630, 635 and 640 which operate similarly to the reflectors/directors of reflector/director array 605. Each of reflector/director arrays 605 and 625 can be coupled to the horizontal antenna array in such a position to reflect or direct RF radiation of vertical antenna array 645.

As illustrated in the exemplary embodiment of FIG. 6, the reflectors/director arrays can be positioned around the vertical antenna array 645 to reflect or direct radiation in a desired direction. The number of reflectors/directors used in a particular array, as well as the number of reflector/director arrays coupled to horizontal antenna array 600, may vary.

Figure 7:
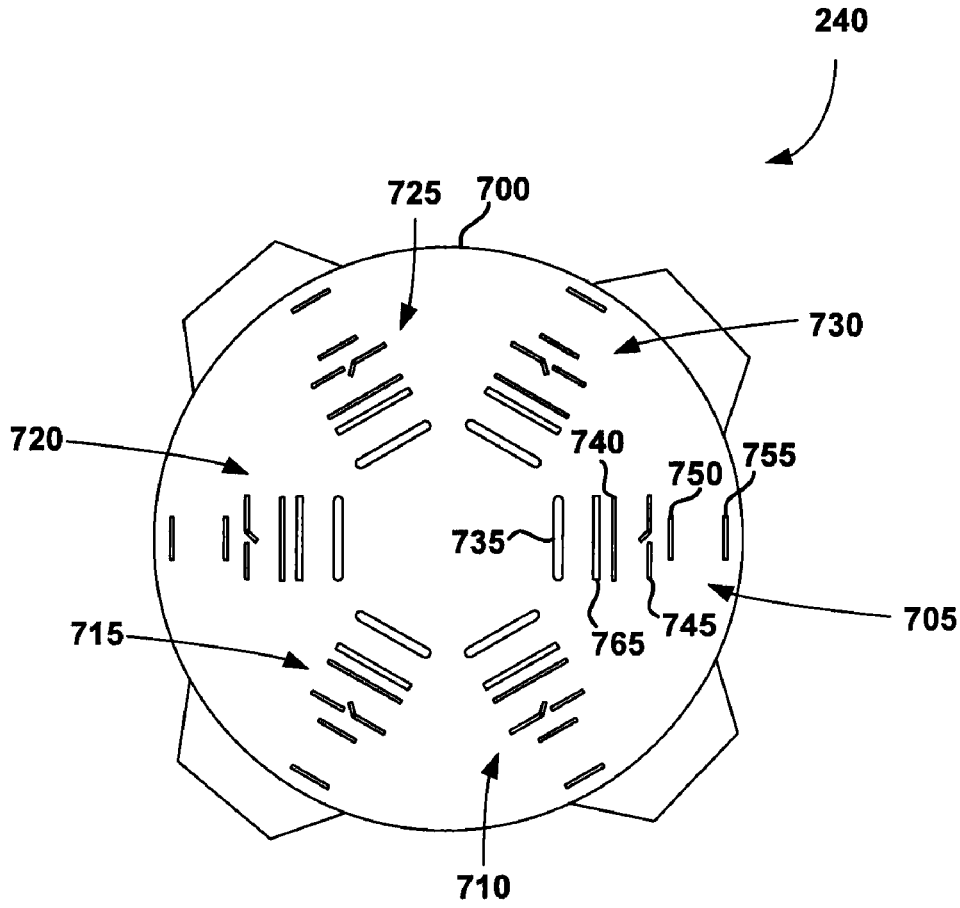
FIG. 7 illustrates a horizontal antenna array having dual band horizontal antenna elements within a PCB board.
Figure 8:
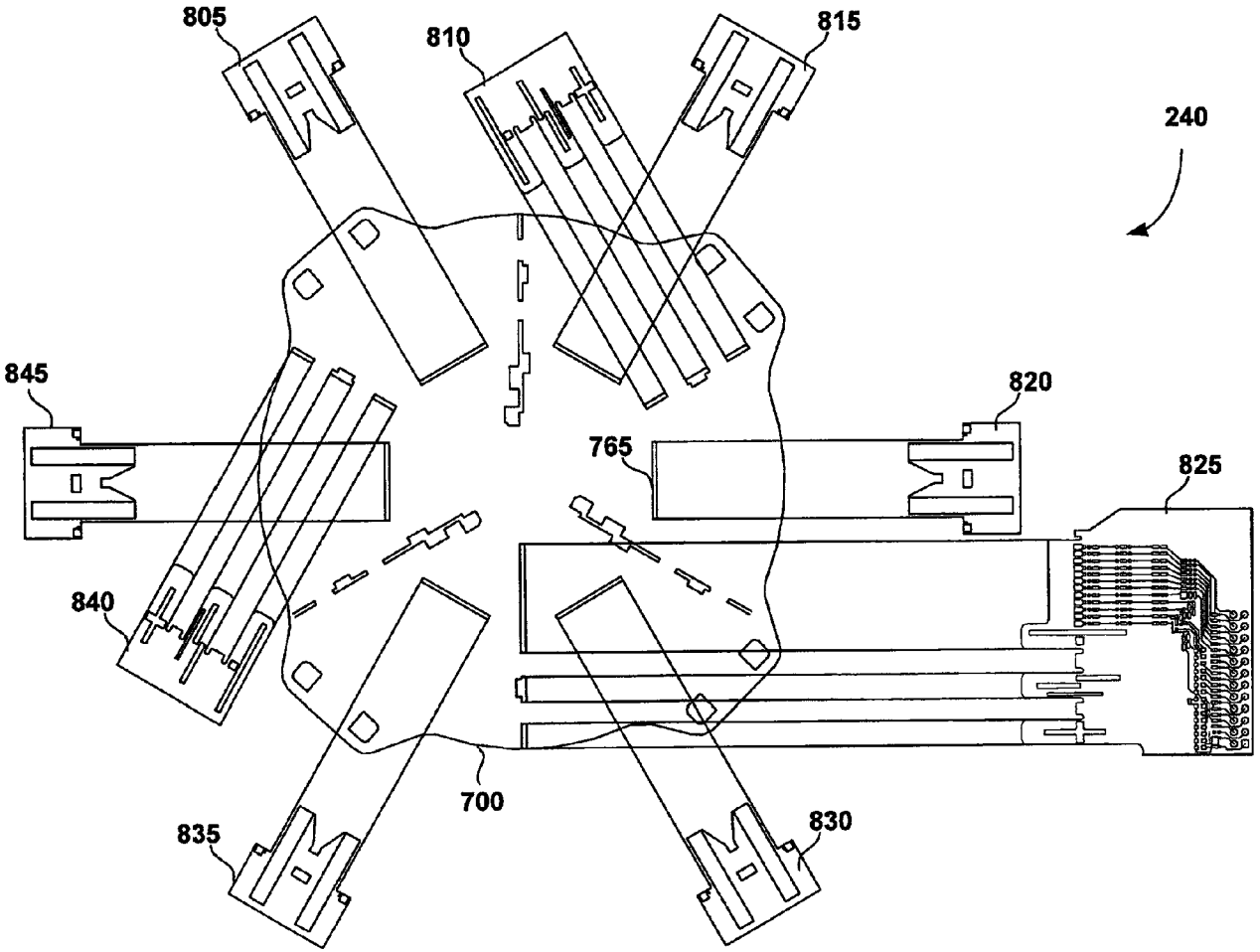
FIG. 8 illustrates a horizontal antenna array coupled to a plurality of high band vertical antenna arrays.
Figure 9:
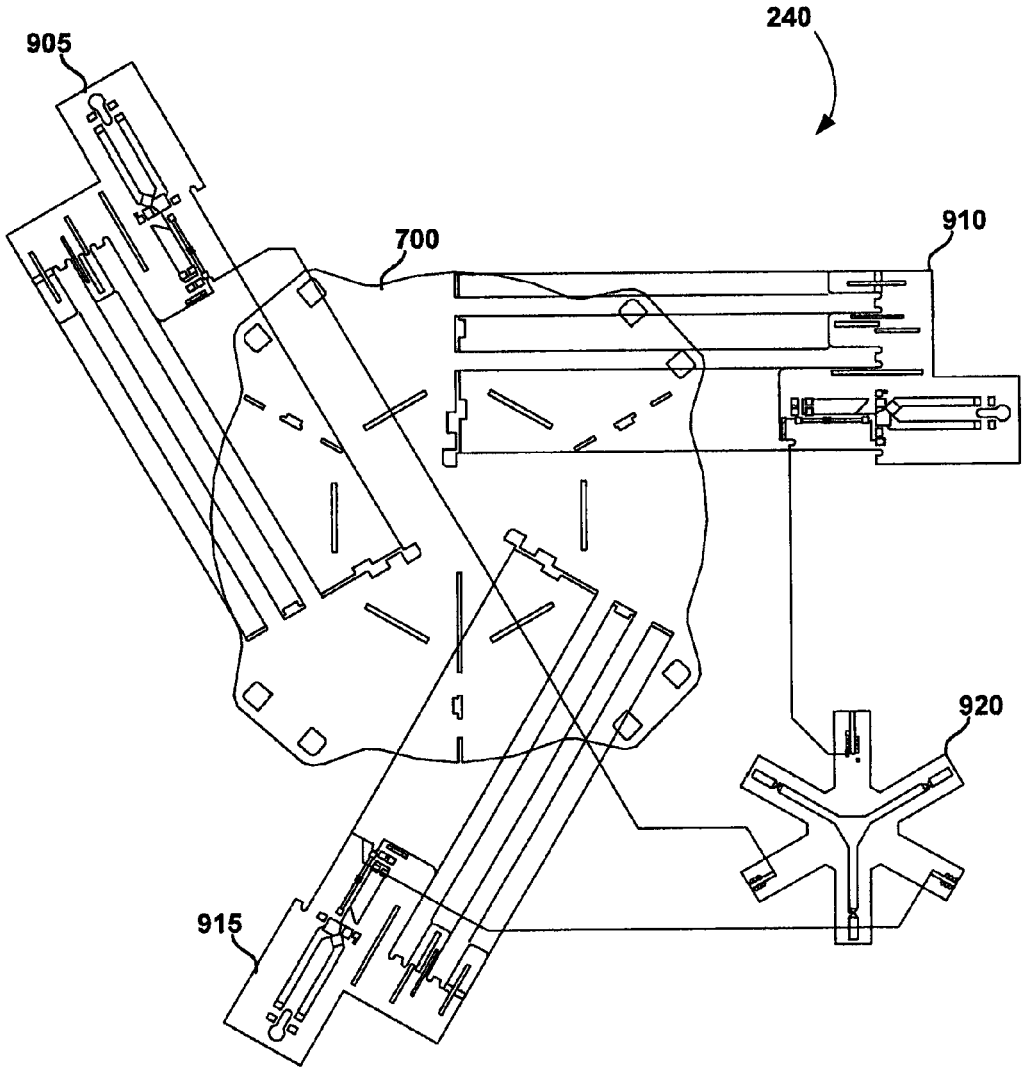
FIG. 9 illustrates a horizontal antenna array coupled to a plurality of low band vertical antenna arrays.

FIGS. 7-9 illustrate an exemplary antenna array configured to concurrently operate with horizontal and vertical polarization with omnidirectional radiation in multiple frequency bands. Various arrays illustrated in FIGS. 7-9 can be coupled to one another through a combination of insertion of the arrays through various PCB feed slits or apertures and soldering/jumping feed traces at intersecting trace elements.

FIG. 7 illustrates an exemplary horizontal antenna array 700 having dual band horizontal antenna elements within a PCB board. The horizontal antenna array includes antenna elements sets 705, 710, 715, 720, 725 and 730. Each antenna element set can be spaced apart equally along the horizontal antenna array, such as sixty degrees apart for six antenna sets. One or more antenna element sets can also be spaced apart unequally across the horizontal antenna array 700.

Each antenna set in exemplary horizontal antenna array 700 can include one or more antenna elements that operate at 2.4 GHz, one or more antenna elements that operate at 5.0 GHz, and one or more passive reflector/director elements. In antenna element set 705, selectable antenna elements 735 may operate at 2.4 GHz and selectable antenna element 745 may operate at 2.4 GHz. Selectable element 740 can form a dipole with element 725 and selectable element 750 can form a dipole with element 745. Each of selectable elements 740 and 750 are passive elements that can be connected to ground. Selectable element 755 is passive element which can be connected to ground for use as a reflector/director.

Only the antenna elements, ground portions and reflector of antenna set 705 are labeled in the horizontal antenna array 700 for purposes of clarity of instruction. Each antenna set of horizontal antenna array 700 may include the labeled components of antenna set 705 or additional or fewer components (e.g., antenna elements, dipole ground elements, and reflectors/directors).

The horizontal antenna elements can be positioned on the horizontal antenna array 700 such that antenna elements that operate at 2.4 GHz are positioned on the inside (closer to the center of the PCB) of antenna elements that operate at 5.0 GHz. The antenna elements which radiate at 2.4 GHz can degrade the radiation signal of the 5.0 GHz antenna elements when the 2.4 GHz antenna elements are in the desired path of the radiation produced by the 5.0 GHz antenna elements. The smaller 5.0 GHz antenna elements have a negligible effect on the radiation of the 2.4 GHz antenna elements. Hence, when radiation is configured to go outward along the plane of the horizontal antenna array PCB, the 2.4 GHz antenna elements (dipole elements 735 and 740 in FIG. 7) will not affect the 5.0 GHz radiation as long as the 2.4 GHz antenna elements are positioned behind the 5.0 GHz antenna elements (dipole elements 745 and 750 in FIG. 7).

Each antenna element within an antenna element array set can be coupled to a switch such that the antenna elements which operate at about 2.4 GHz and about 5.0 GHz can radiate concurrently. Antenna elements within multiple antenna sets can also be configured to operate simultaneously, such as opposing antenna sets 705 and 720, 710 and 725, and 715 and 730.

Horizontal antenna array 700 can be coupled to one or more vertical antenna arrays. The vertical antenna arrays can couple to one or more slits or apertures within the horizontal antenna array, wherein the slits or apertures can be positioned in various positions on the horizontal antenna array PCB board. The horizontal antenna array may include slits or apertures for receiving vertical antenna arrays that operate at 5.0 GHz, vertical antenna arrays that operate at 2.4 GHz, reflectors and directors, or a combination of these. Slits such as 765 in set 705 in FIG. 7 may receive an array of vertical reflectors. Additional slits and the arrays coupled to the horizontal antenna array 700 are discussed in more detail below.

FIG. 8 illustrates an exemplary embodiment of horizontal antenna array 700 coupled to a plurality of high band vertical antenna arrays. Horizontal antenna array 700 has slits for coupling to vertical antenna arrays 810, 825 and 840 and reflector/director arrays 805, 815, 820, 830, 835, and 845. Vertical antenna arrays 810, 825 and 840 as illustrated are configured to operate at about 5.0 GHz and couple to horizontal antenna array 700 through slits spaced about one hundred twenty degrees apart. More or fewer than three vertical antenna arrays can be coupled to horizontal antenna array 700, each of which can be spaced evenly or unevenly around horizontal antenna array 700.

Reflector/director arrays 805, 815, 820, 830, 835, and 845 couple with horizontal antenna array 700 through slits as shown in FIG. 8. Each reflector/director array 805, 815, 820, 830, 835, and 845 includes two passive selectable reflector/directors. The reflector/director arrays 805, 815, 820, 830, 835, and 845 as illustrated can be evenly spaced at about sixty degrees. More or fewer reflector/director arrays can be coupled to horizontal antenna array 700, each of which can be spaced evenly or unevenly around horizontal antenna array 700.

FIG. 9 illustrates an exemplary embodiment of a horizontal antenna array coupled to a plurality of low band vertical antenna arrays. Horizontal antenna array 700 in FIG. 9 has slits for coupling to vertical antenna arrays 905, 910, and 915. Vertical antenna arrays 905, 910, and 915 as illustrated in FIG. 9 each include an antenna element configured to operate at about 2.4 GHz and are collectively spaced about one hundred twenty degrees apart. More or fewer 2.4 GHz vertical antenna arrays can be coupled to horizontal antenna array 700, each of which can be spaced evenly or unevenly around horizontal antenna array 700.

The 2.4 GHz vertical antenna arrays 905, 910, and 915 can be spaced on horizontal antenna array 700 between the 5.0 GHz vertical antenna arrays 810, 825 and 840, for example in an alternating order and spaced apart from the 5.0 GHz vertical antenna arrays by sixty degrees. For example, 5.0 GHz antenna array 815 can be coupled to horizontal antenna array 700 between 2.4 GHz antenna arrays 910 and 915 and directly across from 2.4 GHz antenna array 905.

The vertical antenna arrays 905, 910 and 915 may couple to a position-sensing element 920. The position sensing element 920 may determine the orientation of wireless device 105 as well as detect when the position of the wireless device 105 changes. In response to detecting the position of movement of wireless device 105, radiation patterns of the wireless device can be adjusted. A wireless device with a position sensor and adjustment of radiation patterns based on the position sensor are disclosed in U.S. patent application Ser. No. 12/404,127 filed Mar. 13, 2009 and entitled "Adjustment of Radiation Patterns Utilizing a Position Sensor," the disclosure of which is incorporated herein by reference.

Wireless device 105 with a horizontal antenna array 700 and the vertical arrays illustrated in FIGS. 8-9 can concurrently radiate a horizontally polarized signal as well as a vertically polarized signal at both about 2.4 GHz and about 5.0 GHz (dual polarization and dual band operation). During dual polarization and dual band operation, different combinations of antenna elements can be selected, for example using switches. The switches may couple several antenna elements together to operate simultaneously. One or more single-pole single-throw four way switches can be used to couple groups of opposing vertical antenna arrays and a pair of opposing horizontal antenna arrays which are aligned perpendicular to the opposing vertical antenna arrays.

With respect to the antenna arrays of FIGS. 7-9, a four-way switch can be coupled to horizontal antenna sets 720 and 735, 2.4 GHz antenna array 910 and 5.0 GHz antenna array 825. Another four-way switch can be coupled to horizontal antenna sets 725 and 710, 2.4 GHz antenna array 905 and 5.0 GHz antenna array 810. Yet another four-way switch can be coupled to horizontal antenna sets 715 and 720, 2.4 GHz antenna array 915 and 5.0 GHz antenna array 840.

The antenna array 240 can be a dual polarized, multiple frequency, high-gain, omnidirectional antenna system. While perpendicular horizontal and vertical antenna arrays are disclosed, it is not necessary that the various arrays be perpendicular to one another along a particular axis (e.g., at a 90 degree intersection). Various array configurations are envisioned in the practice of the presently disclosed invention. For example, a vertical array can be coupled to another antenna array positioned at a 45 degree angle with respect to the vertical array. Utilizing various intersection angles with respect to the two or more arrays may further allow for the shaping of a particular RF emission pattern.

A different radio can be coupled to each of the different polarizations. The radiation patterns generated by the varying arrays (e.g., vertical with respect to horizontal) can be substantially similar with respect to a particular RF emission pattern. Alternatively, the radiation patterns generated by the horizontal and the vertical array can be substantially dissimilar versus one another.

An intermediate component can be introduced at a trace element interconnect of an antenna array such as a zero Ohm resistor jumper. The zero Ohm resistor jumper effectively operates as a wire link that can be easier to manage with respect to size, particular antenna array positioning and configuration and, further, with respect to costs that can be incurred during the manufacturing process versus. Direct soldering of the traces may also occur. The coupling of the two (or more) arrays via traces may allow for an RF feed to traverse two disparate arrays. For example, the RF feed may 'jump' the horizontally polarized array to the vertically polarized array. Such 'jumping' may occur in the context of various intermediate elements including a zero Ohm resistor and/or a connector tab as discussed herein.

The embodiments disclosed herein are illustrative. Various modifications or adaptations of the structures and methods described herein can become apparent to those skilled in the art. For example, embodiments of the present invention can be used with respect to MIMO wireless technologies that use multiple antennas as the transmitter and/or receiver to produce significant capacity gains over single-input and single-output (SISO) systems using the same bandwidth and transmit power. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

The embodiments disclosed herein are illustrative. Various modifications or adaptations of the structures and methods described herein can become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A dual band antenna system, comprising:

a plurality of horizontally polarized antenna elements operating at a first frequency and a second frequency;

a plurality of vertically polarized antenna elements coupled to the horizontally polarized antenna elements array and configured to concurrently operating at the first frequency and the second frequency with the horizontally polarized antenna array; and an antenna selector that concurrently selects a first subset of antenna elements of the plurality of horizontally polarized antenna elements to communicate the first frequency and second frequency and a second subset of antenna element of the plurality of vertically polarzied antenna elements to communicate the first frequency and second frequency.

2. The dual band antenna system of claim 1, wherein the first frequency is higher than the second frequency, and the plurality of horizontally polarized antenna elements includes a first antenna element positioned outside of the radiation produced by a second antenna element in the plurality of horizontally polarized antenna element.

3. The dual band antenna system of claim 2, wherein the first antenna element operates at about 2.4 GHz and the second antenna element operates at about 5.0 GHz.

4. The dual band antenna system of claim 2, wherein the first antenna element and the second antenna element are on a single printed circuit board.

5. The dual band antenna system of claim 1, wherein the plurality of horizontally polarized antenna elements includes a first antenna element that operates at the first frequency and a second antenna element that operates at the second frequency.

6. The dual band antenna system of claim 1, wherein a circuit board hosting the plurality of vertically polarized antenna elements couples with a circuit board hosting the plurality of horizontally polarized antenna elements through a slit in the circuit board hosting the plurality of horizontally polarized antenna elements.

7. The dual band antenna system of claim 1, wherein the antenna selector controls a plurality of switches to couple each of the plurality of horizontally polarized antenna elements and each of the plurality of vertically polarized antenna elements to a modulator/demodulator.

8. The dual band antenna system of claim 1, further comprising a plurality of reflectors for reflecting a radiation pattern of the plurality of horizontally polarized antenna elements or the plurality of vertically polarized antenna elements.

9. The dual band antenna system of claim 8, wherein the antenna selector couples a selected reflector to reflect the radiation pattern.

10. The dual band antenna system of claim 1, further comprising a plurality of directors for directing a radiation pattern of the plurality of horizontally polarized antenna elements or the plurality of vertically polarized antenna elements.

* * * * *